US005299354A

United States Patent [19]

Metcalf et al.

[11] Patent Number: 5,299,354

[45] Date of Patent: Apr. 5, 1994

[54] OSCILLATING SHAVER

[75] Inventors: Stephen C. Metcalf, West Newton; Robert A. Trotta, Pembroke; Donald R. Chaulk, Needham, all of Mass.; Hiroshi Harigai, Tokyo, Japan

[73] Assignee: The Gillette Company, Boston, Mass.

[21] Appl. No.: 596,143

[22] Filed: Oct. 11, 1990

[51] Int. Cl.[5] ..... B26B 19/28; B26B 19/12; B26B 19/38

[52] U.S. Cl. ..... 30/45; 30/42; 30/44

[58] Field of Search ..... 30/44, 45, 46, 50, 77, 30/83, 42, 47

[56] References Cited

U.S. PATENT DOCUMENTS

| | | | |
|---|---|---|---|
| 2,078,845 | 4/1937 | Goldschmidt | 30/45 |
| 3,509,626 | 5/1970 | Mead | 30/45 |
| 3,610,080 | 10/1971 | Kuris | 83/13 |
| 3,611,568 | 8/1971 | Alexander et al. | 30/45 |
| 3,636,627 | 1/1972 | Tiffin | 30/45 |
| 3,648,368 | 3/1972 | Douglass et al. | 30/45 |
| 3,772,779 | 11/1973 | Douglass et al. | 30/45 |
| 3,793,723 | 2/1974 | Kuris et al. | 30/45 |
| 4,083,102 | 4/1978 | Harshberger | 30/45 |
| 4,170,821 | 10/1979 | Booth . | |
| 4,337,575 | 7/1982 | Trotta | 30/83 |
| 4,378,633 | 4/1983 | Jacobson | 30/77 |
| 4,488,357 | 12/1984 | Jacobson | 30/57 |
| 4,492,024 | 1/1985 | Jacobson | 30/87 |
| 4,492,025 | 1/1985 | Jacobson | 30/87 |
| 4,498,235 | 2/1985 | Jacobson | 30/47 |
| 4,551,916 | 11/1985 | Jacobson | 30/50 |
| 4,621,424 | 11/1986 | Jacobson | 30/41 |
| 4,642,892 | 2/1987 | Ishida | 30/44 |
| 4,744,144 | 5/1988 | Lowery, Sr. et al. | 30/45 |
| 4,914,816 | 4/1990 | Fenn et al. | 30/45 |

FOREIGN PATENT DOCUMENTS

| | | |
|---|---|---|
| 2198382A | 12/1986 | United Kingdom . |
| 2188581A | 5/1987 | United Kingdom . |

*Primary Examiner*—Douglas D. Watts
*Assistant Examiner*—Paul M. Heyrana

[57] ABSTRACT

An oscillating wet shave razor with a battery powered motor rotating an eccentric element within the head portion of the razor handle to generate an oscillating vibration signal which is transmitted to the razor blade cartridge to desensitize the facial nerves from the discomforts of shaving. The vibration which is transmitted to the cartridge is partially damped in the direction perpendicular to the surface of the cartridge that engages the user's face so that the blades mounted in the cartridge tend not to chop at the whiskers of the user's beard during shaving.

9 Claims, 9 Drawing Sheets

OSCILLATING SHAVER

FIELD OF THE INVENTION

The present relates to a wet shave razor and more particularly to an oscillating wet shave razor with a battery powered motor rotating an eccentric element within the head portion of the razor handle to generate an oscillating vibration signal which is transmitted to a razor blade cartridge which includes blades used to shave the face of the user.

BACKGROUND OF THE INVENTION

Vibrating shaver elements have been known for some time. Traditional electric razors, also known as dr shavers, are used without water or soap or shaving cream. Although such dry electric shavers provide a satisfactory shave many believe that the shave provided by an electric razor is not as close as a wet shave.

Wet shaves traditionally use water and soap or some kind of shave cream to soften the individual hairs of the beard of the user. The water and soap soften the individual hairs of the beard to make them much easier to cut. It would be desirable to combine the beard softening action of a wet shave with the oscillating cutting element of the traditional dry electric shaver.

There have been many attempts to provide an oscillating wet shaver none of which have been entirely satisfactory. Because the wet shave is used in an environment of water, it would be impractcial to plug them into an electrical outlet. Thus, the power source must be housed in the razor itself and should be battery powered. In the past, oscillating wet shavers have been bulky and uncomfortable to use because the battery and motor elements required for such an oscillating shaver tended to be larger than would fit within a traditional wet shave hand-held razor.

It would be desirable to design an oscillating wet shave razor that would accommodate miniaturized motors and batteries that are presently coming available. It would also be desirable to incorporate such miniaturized technology in a handle that provided the desired level of oscillation at the blades of the razors but at the same time reduces the vibration felt by the hand of the user.

Vibration at the surface of the razor blade cartridge is desirable because that vibration has a tendency to massage the skin and isolate the facial nerves from the discomforts of shaving. However, if a large amount of vibration were transmitted through the razor handle to the user's hand, those vibrations could interfere with the touch and feel of the razor.

It would also be desirable to take advantage of the vibrations to assist the blade cartridge in floating over the skin so that the blades would slide more easily over the skin.

It would also be desirable to balance the weight and the vibrations of the razor as a whole so that it would function as a finely crafted instrument having a relatively high vibration at those parts of the razor that interact with blade and a relatively low vibration at those parts of the razor handle that interact with the hand of the user.

It is also important that the mechanism for switching the power on and off be easy to use and conveniently incorporated into a razor.

SUMMARY OF THE INVENTION

The present invention provides many of the advantages and features set forth above and relates to a wet shave razor which has, in the preferred embodiment, a hollow handle made up of a hollow metal body and a hollow plastic head. A cartridge is mounted on the head portion of the handle to pivot about an axis which is generally parallel to the surface of the cartridge which contacts the skin. At least one blade is mounted in the cartridge and the cartridge itself is mounted to the head portion of the handle. A motor with a shaft is fixed into the head portion of the handle close to the cartridge mounting. An eccentric is carried on the motor shaft. The motor is battery powered and controlled by a switch mounted on the handle preferably at the proximal end of the handle. The eccentric is rotated by the motor when the switch is on to provide an oscillating vibration signal. The vibration is transmitted through the motor mounting to the head through the cartridge mounting and thence to the cartridge body to cause the cartridge body to vibrate at a frequency of about 5,000 to 6,500 vibrations per minute with an amplitude of about 0.002 inches to 0.007 inches and most preferably at an amplitude of 0.003 inches. The blades are mounted in the cartridge body resiliently so that the resilient mounting substantially damps the vibration transmitted to the blades thereby reducing the motion of the blades in the direction generally perpendicular to the surface of the cartridge which contacts the skin so as to reduce chopping action of the blades against the hairs of the beard to be shaved.

The vibration imparted to the cartridge body has the tendency to reduce the coefficient of friction between the cartridge and the face of the user to facilitate shaving comfort. The motor and eccentric are positioned in the head and the eccentric is shaped to place the center of percussion of the vibration of the entire razor instrument generally in the middle of the handle near the grip to reduce the sensation of vibration felt by the hands of the user. In the preferred embodiment the razor also includes a rubber grip to further reduce vibration transmitted to the user's hand.

The handle body is hollow to provide a compartment for receiving the battery which powers the motor. The proximal end of the handle body is sealed by a plug which also functions as a switch. The switch can be turned on and off by rotating in the same direction. This is believed to be more ergonomically suitable than a switch which must be rotated in one direction to turn it on and another direction to turn it off. The switch also provides an audible click and a tactile feel as it switches from one position to another to make it still easier to use in the shaving environment.

The motor and battery compartment are sealed against liquids like water and shaving cream that are found in the wet shave environment.

The switch is a detent type switch which includes a generally annular axially extending member whose distal end threads into the proximal end of the handle body. An end cap is attached to the proximal end of the annular switch member so that it may rotate with respect to the annular member. The end cap supports a switch actuator which rotates with the end cap and has at least one cam follower attached to it. There is a switch cam mounted to slide axially within the annular member. The switch cam has a cam surface mating with the cam follower. Switch contacts are mounted on the switch cam. There is a bias spring inside the switch to hold the switch cam against the cam follower. As the end cap is turned, the cam follower causes the switch cam to reciprocate within the annular member to open and close the contacts and turn the motor on and off.

These and other features and advantages of the present invention become apparent from the following detailed description of the preferred embodiment taken in conjuction with the following drawing.

DETAILED DESCRIPTION OF THE PREFERRED EMBODIMENT

Figure 1:
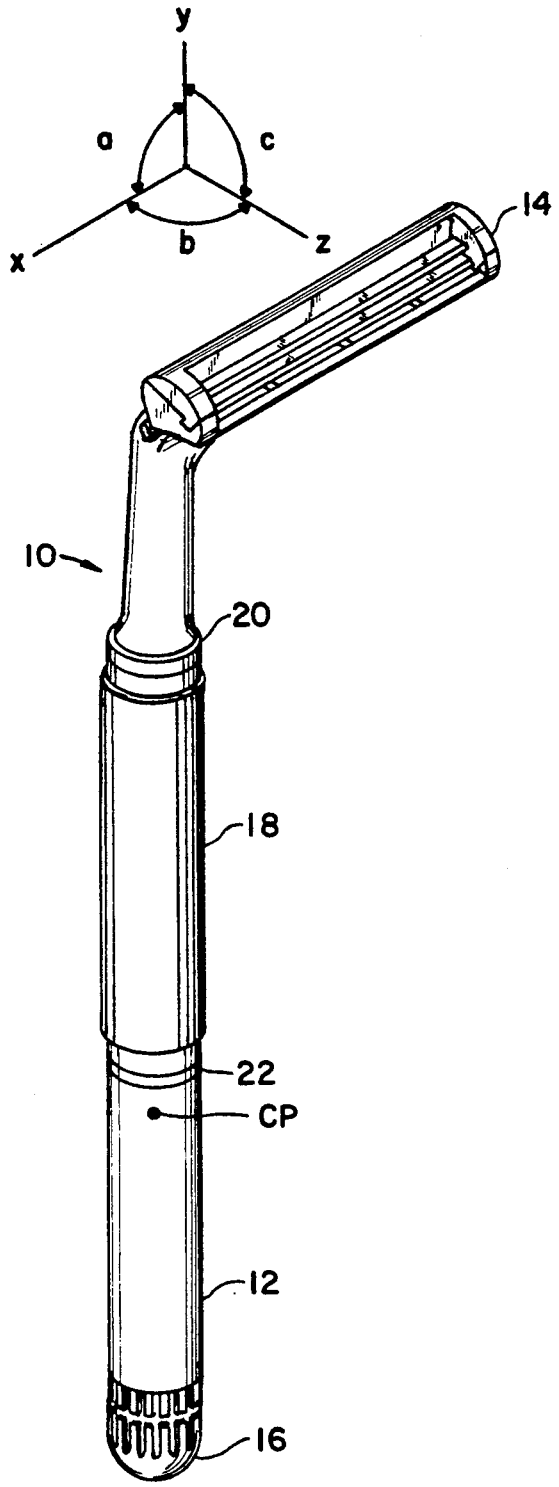
FIG. 1 shows a perspective view of the oscillating razor of the present invention.

Referring now to FIG. 1 there is shown the oscillating razor (10) of the present invention having a handle (12), a cartridge (14) and a switch (16). Cartridge (14) is supported on handle (12) so that it may rotate about the (X) axis through angle (c) as shown in FIG. 1. FIG. 1 also inside razor shows the center of percussion (CP) of the vibration of the razor to be close to the center of handle (12) near grip (18). Cartridge (14) supports one or more blades (15).

Handle (12) incorporates an elastomeric grip (18) Preferably made of rubber or some other suitable soft high friction material and also incorporates head accent ring (20) and handle accent ring (22).

Figure 2:
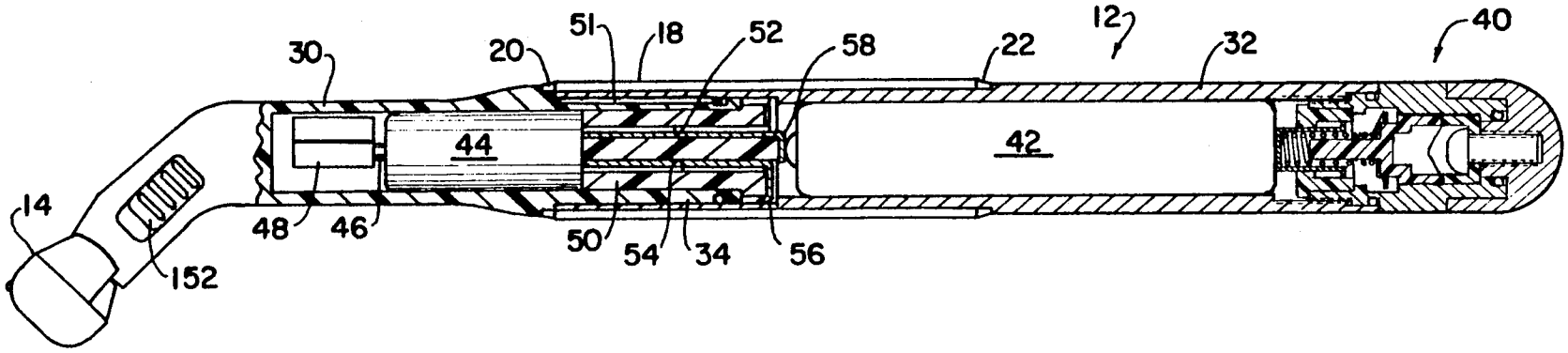
FIG. 2 shows a side perspective view, partly in section, of the razor of FIG. 1.

Referring now to FIG. 2 there is shown a side view partly in section of the razor in FIG. 1. Handle (12) is made up of a head portion (30) and a handle body (32) keyed together at (51) so that one may not rotate with respect to the other about the longitudinal axis of handle (12). The distal end of head (30) supports cartridge (14). The proximal end of head (30) fits inside the distal end of handle body (32).

Throughout this application we will use the term distal to apply to that portion of the part closer to the user's face during shaving and we will use the word proximal to refer to that portion of the element farther from the user's face during shaving.

The proximal end (34) of head (30) includes an annular recess (36) into which an "O" ring (38) is placed to seal the joint between head (30) and handle body (32).

Head (30) is made preferably of high strength plastic material suitable for transmitting vibration. Handle body (32) is preferably made of a metallic material suitable for completing an electrical circuit as will be explained later in the application.

The proximal end of handle (12) includes a plug (40) for closing the proximal end of handle (12) to provide a compartment within handle (12) for battery (42). As will be explained later in the application, plug (40) also incorporates switch mechanism (16).

Handle (12) also houses motor (44) with shaft (46) which supports eccentric (48) for rotation within head (30). Motor (44) is glued into head portion (30) of handle (12) close to cartridge (14) with a suitable glue. Insulating spacer (50) includes first and second passages (52) and (54) for receiving first and second terminals (not shown) of motor (44) and for housing ground terminal (56) and positive terminal (58) for connecting motor (44) to battery (42).

Figure 3:
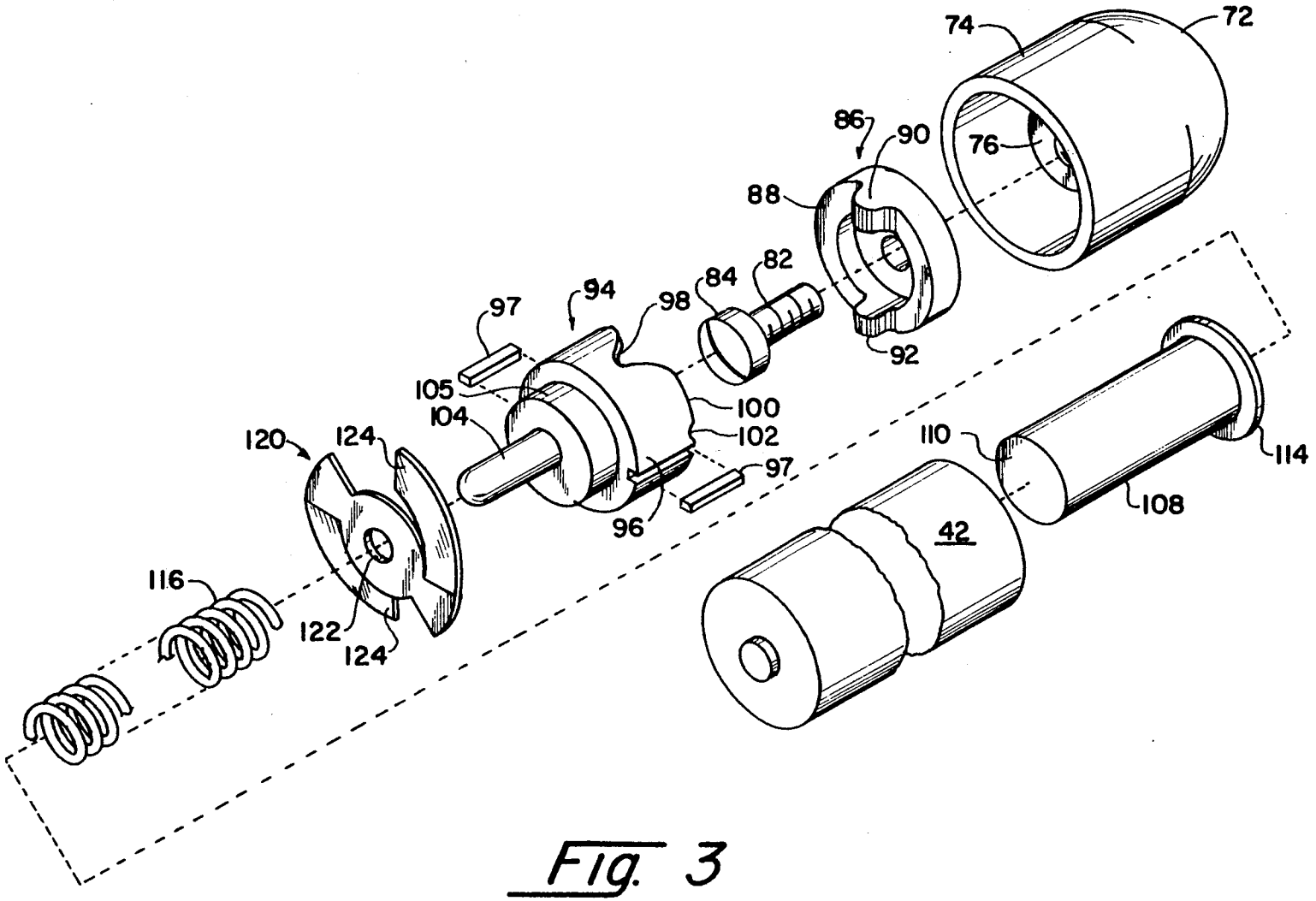
FIG. 3 shows a partial, exploded perspective of the switch for the razor.
Figure 12:
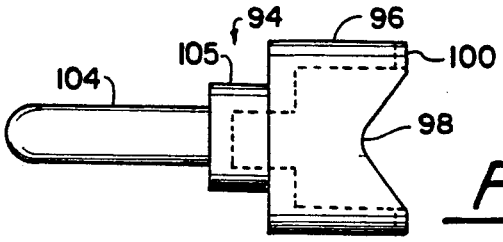
FIG. 12 shows a side elevational view of an element of the switch mechanism.

The switch will now be discussed in connection with FIGS. 3, 4*a* and 4*b*. Plug (40) includes two external parts and several internal parts that make up the switch that allows the battery (42) to operate motor (44). Plug (40) includes a generally annular member (60) which has a reduced diameter at its distal end (62), the outside surface of which incorporates threads (64) which screw into cooperating threads (66) on the inside diameter of the proximal end of handle (12). A central portion (68) of annular member (60) has a generally cylindical outside surface of the same diameter as the outside surface of handle (12). The proximal portion (70) of annular member (60) has a reduced diameter for receiving end cap (72). End cap (72) has a surrounding circumferential flange (74) having an outside diameter equal to the outside diameter of handle (12) and a centrally disposed axially extending boss (76) having an outside diameter providing a sliding fit with the inside diameter of the adjacent portion of the proximal end of (70) of annular member (60). The confronting surfaces of boss (76) and proximal portion (70) of annular member (60) include a recess for receiving an "O" ring to seal end cap (72) to prevent liquid from getting inside plug (40). End cap (72) rotates freely with respect to annular member (60).

Central boss (76) includes a coaxial bore (80) for receiving a fastener (82) with head (84) to hold switch actuator (86) in place fixed with respect to end cap (72). Switch actuator (86) has a generally disk shaped cylindrical base (88) with two axially extending arms (90 and 92) at its perifery.

Switch cam (94) has a generally cylindrical hollow cup portion (96) with an outside diameter chosen to have a clearance sliding fit within a central lumen (61) of annular member (60). Key (97) which fits corresponding keyway on annular member (60) (not shown) prevents switch cam (94) from rotating within annular member (60). Cup portion (96) has a pair of generally "V" shaped slots (98) in its sidewall to receive arms (90 and 92) of switch actuator (86). Arms (90 and 92) are disposed 180 degrees apart and "V" shaped slots (98) are similarly aligned 180 degrees apart on switch cam (94). The proximately facing surface (100) of cup (96) also has two detents (102), see FIG. 3, spaced 180 degrees apart from each other and 90 degrees from the "V" slots (98). Switch cam (94) also includes a central axially extending boss (104) extending in the distal direction into the annular space defined by distal portion (62) of annular member (60).

Generally annular bias spring housing (106) is placed in the annular space defined by the distal end (62) of annular member (60) and has an inwardly extending flange (107) on its distal end. Spring retainer (108) has a closed distal end (110) and opened proximal end (112) with an outwardly extending flange (114) about open proximal end (112) having a diameter larger than the diameter of flange (107) on bias spring housing (106). Bias coils spring (116) is received in spring retainer (108) and fits about the exterior of boss (104) of switch cam (94).

Figure 4A:
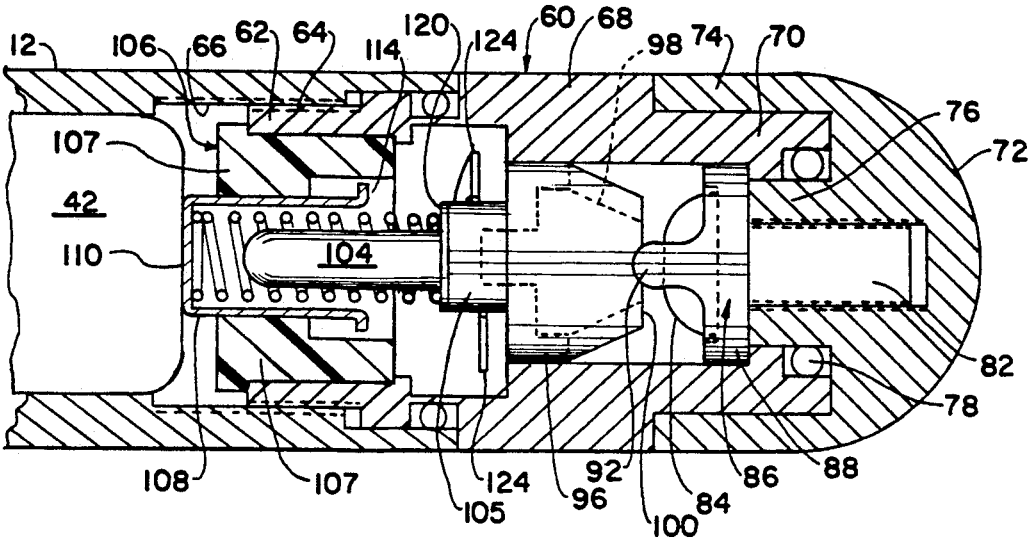
FIG. 4*a* shows a cross section view of the switch in the open position.
Figure 4B:
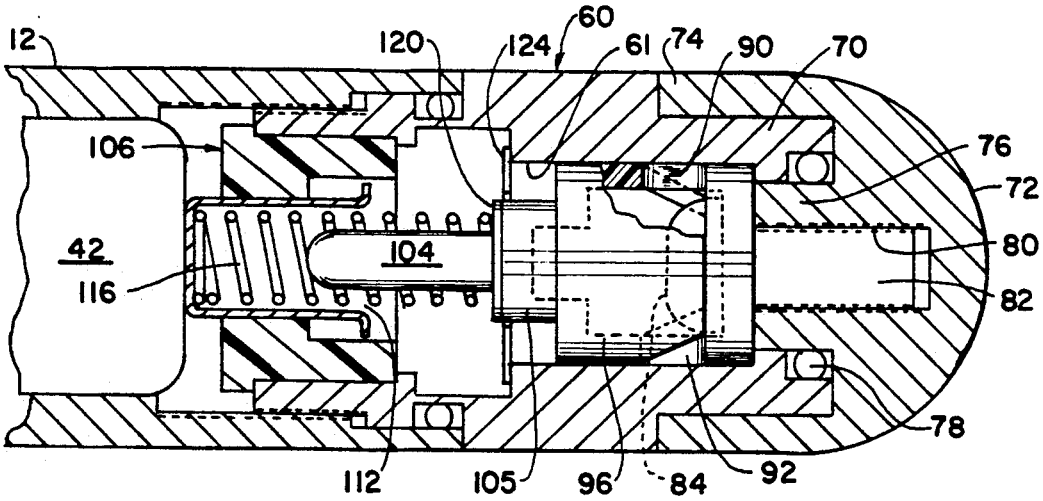
FIG. 4*b* shows a cross section view of the switch in the closed position.

Still referring to FIGS. 4*a* and 4*b*, one can see disk shaped switch contact (120) with a central opening (122) dimensioned to press fit about boss (104). Spring contact (120) has a two spiral arms (124) extending from its perifery in opposite circumferencial directions so as to fit with clearence fit about the outside diameter of central boss (105) of switch cam (94).

Annular member (60), end cap (72), switch contact (120), spring (116), spring retainer (108) and handle (112) are all preferably made of an electrically conductive material. Preferably end cap (72), annular member (60), spring contacts (120) and spring retainer (108) are all made of brass. Coil spring (116) is preferably made of Phosphor Bronze as is handle body 32.

Referring still to FIGS. 4*a* and 4*b*, the operation of the switch will now be described. The user may rotate end cap (72) and with it switch actuator (86) causing arms (90 and 92) of switch actuator (86) to rotate from detents (102) into the "V" shaped notches (98), thus allowing switch cam (94) to move to the right in FIG. 4*a* allowing switch contacts (120) and switch contact arms (124) to correspondingly move to the right in FIG. 4*a* under the influence of spring (116) so as to make electrical contact between arms (124) and the central portion (63) of annular member (60).

Figure 5:
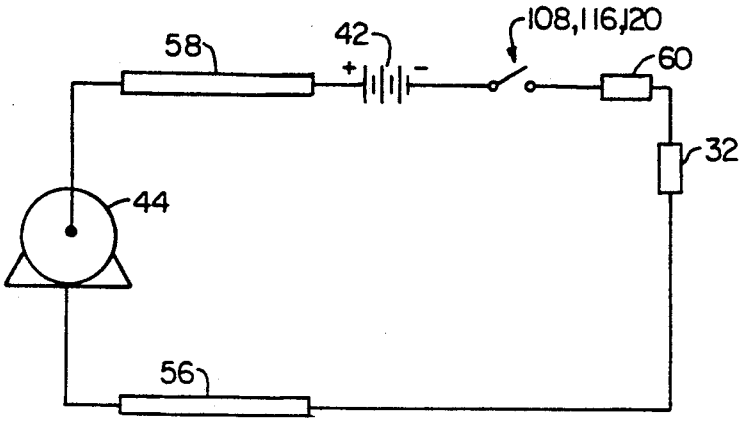
FIG. 5 shows a schematic representation of the electric circuit.

The electrical circuit for this razor will be described in connection with FIG. 5. Motor (44) is connected in series to positive contact (58) which is connected in series to battery (42) again connected in series to spring retainer (108) and spring (116), connected in series to switch contacts (120). When the contacts are closed, switch contacts (120) engage annular member (60) which is physically connected to and electrically connected to metal handle body (32) which is connected in series to ground terminal (56) which is connected to series to motor (44) to complete the electrical circuit.

When the switch is on the motor rotates at a speed of about 5,000 to 6,500 revolutions per minute which drives eccentric member (48) at the same speed.

Figure 11:
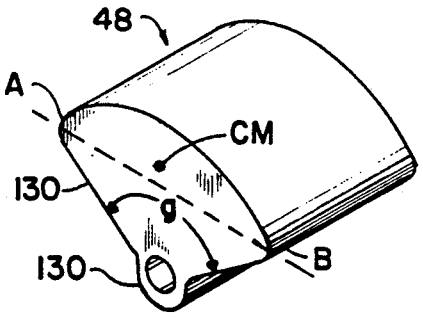
FIG. 11 shows a perspective view of the eccentric element shown in FIG. 2.

Eccentric member (48) is shown in FIG. 11 and includes a hub portion (130) integrally connected to a weighted mass (132). The center of mass (CM) is located radially outwardly of a line passing through points A and B on eccentric member (48). Point A is the point where the first edge radius of eccentric element (48) meets the circumference of the segment of the circle formed by weighted mass (132) and point B is at the second edge of mass (132) where the second edge radius meets the circumference. The included angle of the segment of the circle defined by weighted mass (132) forms an angle (g) which in the preferred embodiment is approximately 150 degrees but should be less than 180 degrees.

The vibration generated by the rotation of eccentric member (48) is transmitted to the motor which is glued into the proximal portion (34) of head (30) so that the vibration is transmitted from motor (44) to head (30) and then to cartridge (14) through the cartridge mounting system which will now be described in connection with FIGS. 6*a* and 6*b*.

A special bearing (150) mounts in the distal end of head (30) so that buttons (152) project through opening on either side of head (30) see FIG. 2. Bearing (150) fits snuggly into a recess in the distal end of head (30). A cam (154) fits snuggly within head (30). Cam (154) includes an axillar bore (156) which receives spring (158). Leaf spring (160) includes slots (162) which are captured in tabs (164). Leaf spring (160) helps keep buttons (152) projecting through head (30). Arms (166) fit under retainers (168) to hold cam (154) in place against the action of coil spring (158).

Bearing (150) and its associated cam (154) fit into and firmly contact the interior structure of the distal end of head (30) to transmit the vibration of head (30) to bearing (150) and cam (154).

Cam (154) has a key (170) which fits into a slot (172) in the distal end of head (30).

Figure 6A:
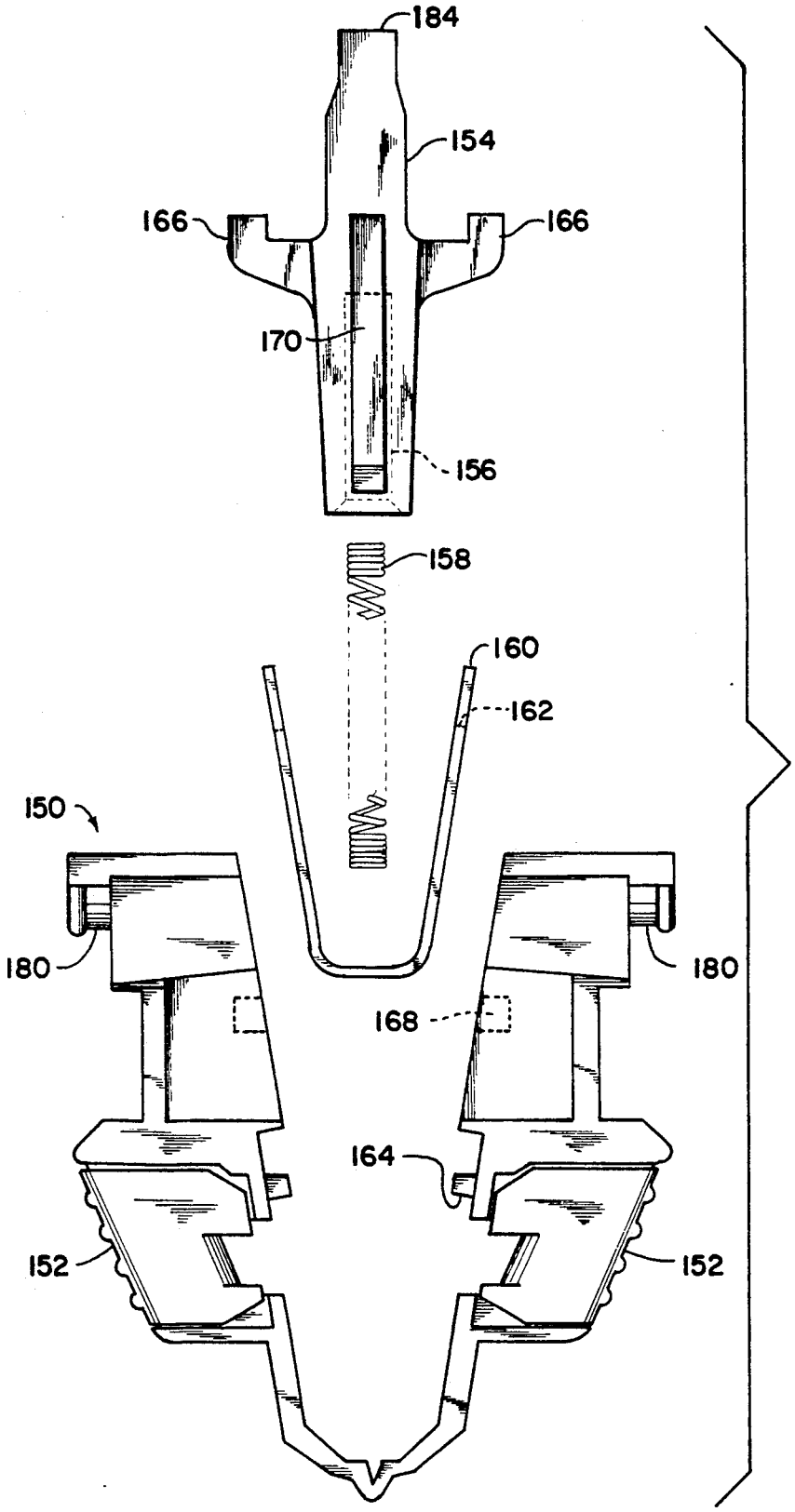
FIGS. 6*a* and 6*b* show a combined exploded plan view, partly in section, of the head and the cartridge support portion of the razor shown in FIG. 1.
Figure 6B:
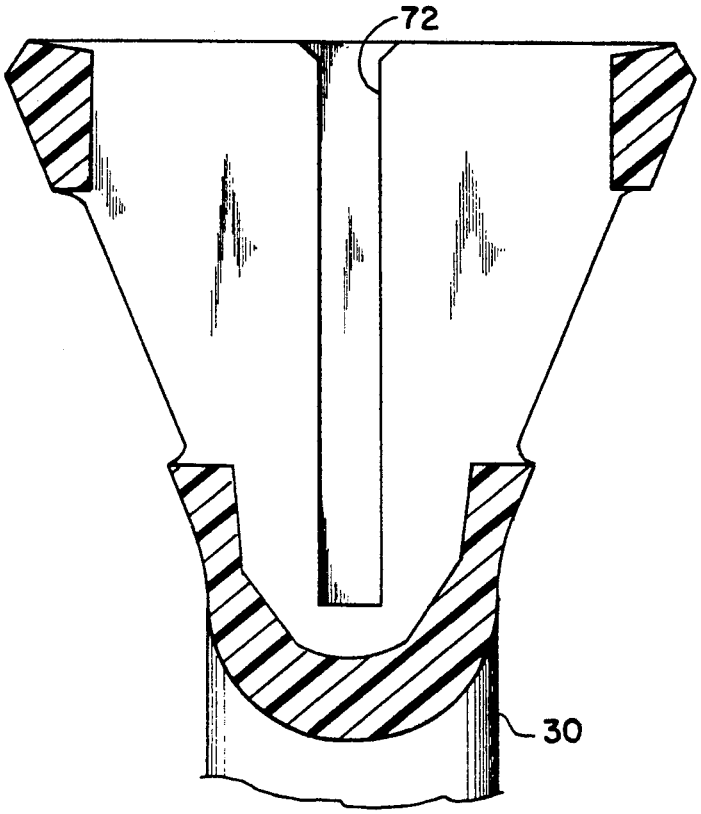

It will be noted that FIGS. 6*a* & 6*b* should be read together as a combined exploded plan view, partly in section, to show the elements which mount cartridge (14) to head (30).

Figure 7:
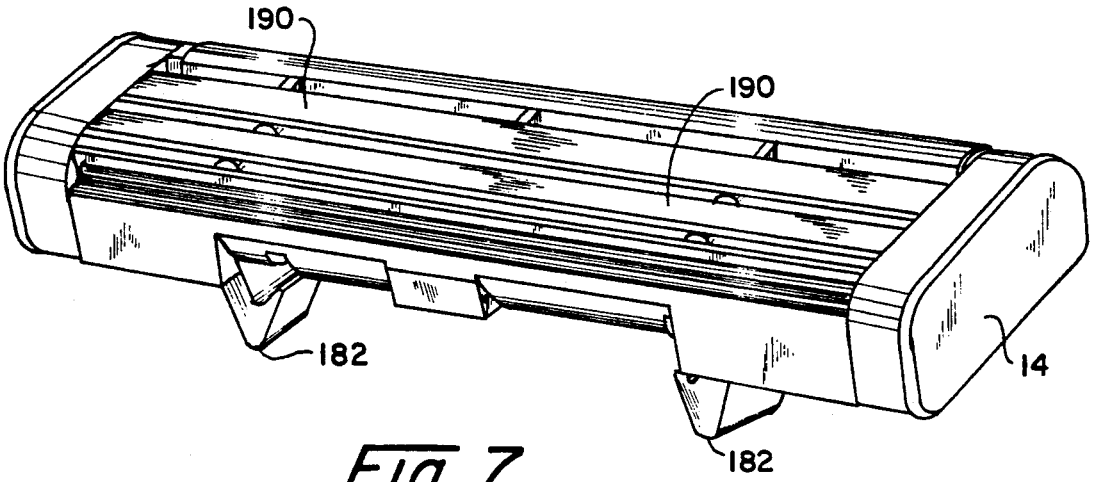
FIG. 7 shows a perspective view of the cartridge shown in FIG. 1.

Bearing (150) has receivers (180) for receiving hooks (182) of cartridge (14) (see FIG. 7). The distal end (184) cam (154) engages surface (186) of cartridge (14) (see FIG. 9).

Figure 10:
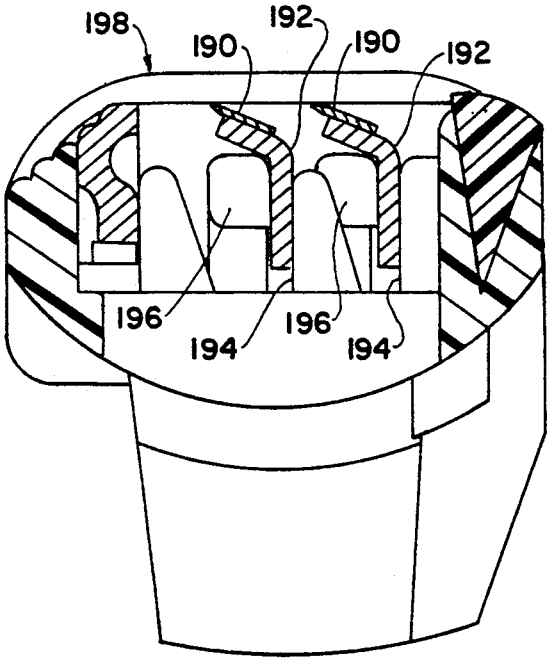
FIG. 10 shows side cross sectional view taken along lines 11—11 in FIG. 9.
Figure 8:
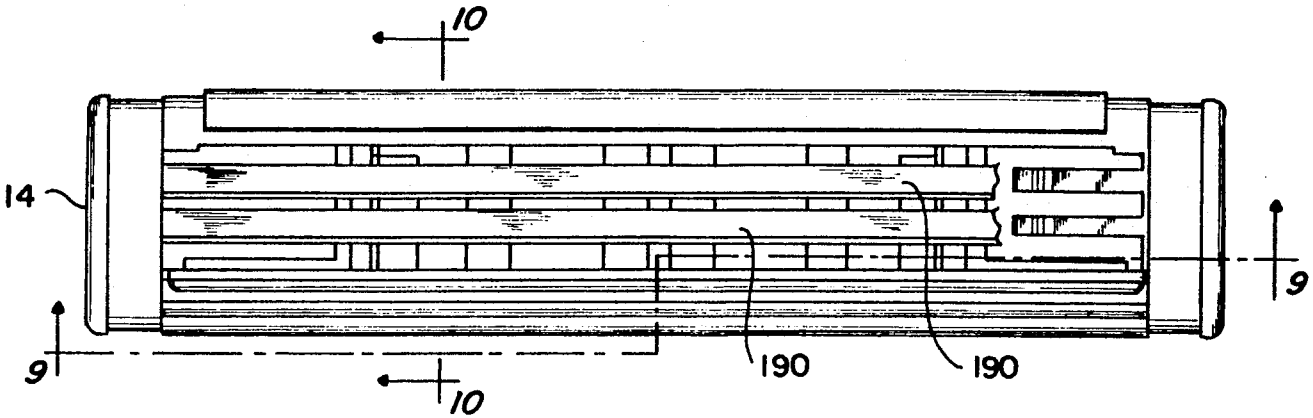
FIG. 8 shows a top view of the cartridge in FIG. 7.
Figure 9:
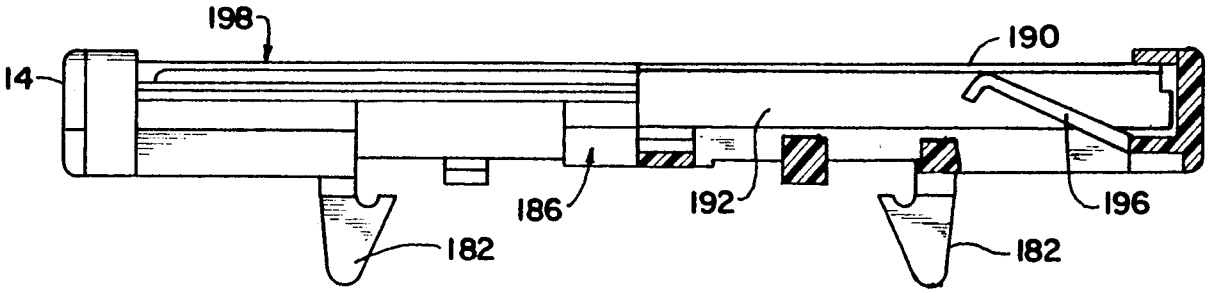
FIG. 9 shows a front elevation, partly in section, of the cartridge in FIG. 7.

Referring now to FIGS. 8, 9 and 10, one can see blades (190) fixed to blades supports (192). Blade supports (192) fit in slots (194) and rest on the surface of spring fingers (196). Spring fingers (196) permit blade supports (192) and correspondingly blades (190) to freely float in a direction generally perpendicular to the surface of (198) of cartridge (14) which engages the user's face during shaving. Thus, the vibration signal that is transmitted to cartridge (14) tends to be damped by spring fingers (196) in the direction perpendicular to the surface (198) which engages the user's face so as to reduce the tendency of blades (190) to chop at the whiskers of the user's beard. The pivoting action of cartridge (14) allows the cartridge to conform to contours of the face. This is important due to the anesthetic effect of the vibration on the facial nerves which may make it hard for the user to adjust the angle of the blade to the skin if the blade did not follow the contour of the face by itself.

The oscillating razor of the present invention is comparable in size to an ordinary wet shave razor. Handle (12) has a small outside diameter and an inside battery compartment designed to house a battery of no more than about 9 millimeters. Motor (44) has a diameter of less than that of the battery such the it may be easily housed in head portion (30) of handle (12) close to cartridge (14). Placing the motor in such close proximity to the cartridge (14) makes the vibration characteristics of the entire razor better by focusing the oscillation closer to the face and further from the hands.

Although the spring mounting of the blades in cartridge (14) reduces the tendency of blades (190) to chop at the whiskers of the beard, the cartridge does permit the blades to move back and forth in the directions generally parallel to the long axis of the blades so as to slice the whiskers and facilitate cutting.

The rotational speed of eccentric elements (48) is important to the performance of the razor and to the perception of acceptable performance. A speed of rotation of element (48) of less than about 5,000 revolutions per minute appears to provide little or none of the benefits expected from the vibratory shaver. Speeds above 5,000 rpm appear to provide the benefits sought, but at about 6,500 rpm the vibrations reach a level at which the user perceives lack of steadiness, an unpleasant sensation on the surface being shaved, and a handle vibration which is too great. It is believed that a speed of between about 5,000 rpm and 6,500 rpm provides the maximum performance desired from a vibratory razor.

The present invention has been described in connection with certain preferred embodiments. Certain modifications to the preferred embodiments will occur to those skilled in the art. Thus, it is not intended to limit the scope of patent protection to the structure described in this preferred embodiment but only to limit the scope of the invention as set forth in the following claims.

What is claimed is;

1. A wet shave razor comprising:

a handle having a hollow body and a hollow head; wherein said handle includes, a hollow tube portion open at its proximal end to provide a battery compartment to permit the insertion of a battery therein;

plug means removably mounted in the proximal end of said handle body; and, sealing means cooperatively disposed with respect to said plug and said handle body to provide a liquid seal for said battery compartment, a cartridge having a body, said body having a surface for engaging the skin of the user and said body having at least one blade resiliently mounted therein and biased relative to said skin engaging surface;

means for pivotably mounting said cartridge to said heads so that said cartridge may rotate about an axis generally parallel to the surface of said cartridge body which engages the skin of the user;

a motor fixedly mounted in the head portion of said handle close to said cartridge mounting means, said motor having a shaft extending therefrom;

an eccentric element fixedly connected to said shaft and disposed for rotation within said hollow head;

a battery operatively connected to said motor; and switch means on said handle for turning said motor on and off, said switch means incorporated into said plug means and further including, a generally annular axially extending member having a distal end and a proximal end and a central lumen, cooperating threads on the distal end of said annular member for securing said annular member to the proximal end of said handle body, an end cap rotatably affixed to said proximal end of said annular member having a closed end, a circumferential wall and a central boss projecting axially from said end cap, a switch actuator affixed to said end cap and rotatable therewith and having at least one cam follower, a switch cam mounted to slide axially within said annular member and having a cam surface mating with said cam follower, switch contact means mounted on said switch cam, and biasing means for biasing said switch cam against said cam follower and providing an electrical contact with said battery whereby said end cap rotates with respect to said annular member, said switch actuator similarly rotates to place said switch cam in a first position wherein said switch contacts are opened and whereby in a second position said switch actuator moves said switch cam to a second position whereby said switch contacts are closed causing said battery to energize said motor and rotate said eccentric member, said eccentric element rotated from about 5,000 rpm to about 6,500 rpm by said motor to provide a vibration signal, said vibration signal transmitted through said motor mounting to said head, through said cartridge mounting means and then to said cartridge body, causing said cartridge body to vibrate with an amplitude of about 0.002 inches to about 0.007 inches;

said resilient mounting of said blades in said cartridge body substantially damping the vibration transmitted to said blades and thereby reducing the motion of said blades in the direction generally perpendicular to the surface of the cartridge body which engages the face of the user so as to reduce chopping action of the blades against the hairs of the beard to be shaved;

said vibration imparting a motion to said cartridge body so as to reduce the coefficient of friction between said cartridge body and the face of the user to facilitate shaving comfort.

2. The razor of claim 1 generally including an annular housing for said bearing means fixed in the distal end of said annular member and having a flange extending radially inwardly, said biasing means including a coil spring;

a post projecting axially from said switch cam to fit within one end of said coil spring; and a flanged spring retainer to receive the other end of coil spring, said retainer disposed within said annular housing and said retainer flange engaging said biasing means housing flange to hold said flanged retainer in place.

3. The razor of claim 1 wherein said switch contacts include an annular disk mounted on said switch cam post and having at least one arm extending therefrom.

4. A wet shave razor comprising:

a handle having a hollow handle body and a hollow head portion; wherein said hollow handle body further includes at its proximal end, a battery compartment sized to permit the insertion of a battery therein;

plug means removably mounted in said proximal end of said handle body; and, sealing means cooperatively disposed with respect to said plug means and said handle body to provide a liquid seal for said battery compartment, a cartridge having a body, said body having a surface for engaging the skin of the user and having at least one blade resiliently mounted therein and biased relative to said skin engaging surface;

cartridge mounting means for pivotally mounting said cartridge to said head portion so that said cartridge may rotate about an axis generally parallel to said skin engaging surface of said cartridge body;

a motor fixedly mounted in said head portion adjacent said cartridge mounting means, said motor having a shaft extending therefrom;

an eccentric element fixedly connected to said shaft and disposed for rotation within said hollow head portion;

a battery electrically connectable to said motor; and switch means on said handle body for electrically connecting said battery to said motor, wherein said switch means is incorporated into said plug means and further includes, a generally annular axially extending member having a distal end and a proximal end and a central lumen;

cooperating threads on the distal end of said annular member for securing said annular member to the proximal end of said handle body;

an end cap rotatably affixed to said proximal end of said annular member having a closed end, a circumferential wall and a central boss projecting axially from said end cap;

a switch actuator affixed to said end cap and rotatable therewith and having at least one axially extended arm;

a switch cam mounted to slide axially within said annular member and having a cam surface mating with said at least one axially extending arm;

switch contact means mounted on said switch cam; and, biasing means for biasing said switch cam against said switch actuator and providing an electrical contact with said battery whereby said end cap rotates with respect to said annular member, said switch actuator similarly rotates to place said switch cam in a first position wherein said switch contacts are opened and whereby in a second position said switch actuator moves said switch cam to a second position whereby said switch contacts are closed causing said battery to be electrically connected to said motor, said eccentric element rotated from about 5,000 rpm to about 6,500 rpm by said motor to provide a vibration signal, said vibration signal transmitted through said motor mounting to said head, through said cartridge mounting means and then to said cartridge body, causing said cartridge body to vibrate with an amplitude of about 0.002 inches to about 0.007 inches;

said resilient mounting of said at least one blade in said cartridge body substantially damping the vibration transmitted to said at least one blade and thereby reducing the motion of said at least one blade in the direction generally perpendicular to said skin engaging surface of said cartridge body, so as to reduce chopping action of said at least one blade against the hairs of the beard to be shaved; said vibration imparting a motion to said cartridge body so as to reduce the coefficient of friction between said cartridge body and the face of the user to facilitate shaving comfort.

5. The apparatus of claim 4 generally including an annular housing for said biasing means fixed in the distal end of said annular member and having a flange extending radially inwardly, said biasing means further including;

a coil spring;

a post projecting axially from said switch cam to fit within one end of said coil spring;

a flanged spring retainer to receive the other end of said coil spring, said retainer disposed within said annular housing and said retainer flange engaging said biasing means housing flange to hold said flanged retainer in place.

6. The apparatus of claim 4 wherein said switch contacts include an annular disk mounted on said switch cam post and having at least one arm extending therefrom.

7. A wet shave razor apparatus for use in shaving, said apparatus comprising:

a handle having a hollow handle body and a hollow head portion; wherein said hollow handle body further includes at its proximal end, a battery compartment sized to permit the insertion of a battery therein;

plug means removably mountable in said proximal end of said handle body; and, sealing means cooperatively disposable with respect to said plug means and said handle body to provide a liquid seal for said battery compartment, a cartridge having a body, said body having a surface for engaging the skin of the user and having at least one blade resiliently mountable therein and biasable relative to said skin engaging surface;

cartridge mounting means for pivotally mounting said cartridge to said head portion so that said cartridge may rotate about an axis generally parallel to said skin engaging surface of said cartridge body;

a motor fixedly mountable in said head portion adjacent said cartridge mounting means, said motor having a shaft extending therefrom;

an eccentric element fixedly connectable to said shaft and sized for rotation within said hollow head portion; and switch means mountable on said handle body capable of electrically connecting a battery to said motor, wherein said switch means is incorporatable into said plug means and further includes, a generally annular axially extending member having a distal end and a proximal end and a central lumen;

cooperating threads on the distal end of said annular member for securing said annular member to the proximal end of said handle body;

an end cap rotatably affixable to said proximal end of said annular member having a closed end, a circumferential wall and a central boss projecting axially from said end cap;

a switch actuator affixable to said end cap and rotatable therewith and having at least one axially extended arm;

a switch cam mountable to slide axially within said annular member and having a cam surface matable with said at least one axially extending arm;

switch contact means mountable on said switch cam; and biasing means capable of biasing said switch cam against said switch actuator and providing an electrical contact with said battery when said battery is installed in said battery compartment whereby when said apparatus is assembled said end cap rotates with respect to said annular member, said switch actuator similarly rotates to place said switch cam in a first position wherein said switch contacts are opened and whereby in a second position said switch actuator moves said switch cam to a second position whereby said switch contacts are closed causing said battery when installed to be electrically connected to said motor, said eccentric element rotatable from about 5,000 rpm to about 6,500 rpm by said motor to provide a vibration signal, said vibration signal transmittable through said motor mounting to said head, through said cartridge mounting means and then to said cartridge body, said signal capable of causing said cartridge body to vibrate with an amplitude of about 0.002 inches to about 0.007 inches;

said resilient mounting of said at least one blade in said cartridge body substantially damping the vibration when transmitted to said at least one blade and thereby reducing the motion of said at least one blade in the direction generally perpendicular to said skin engaging surface of said cartridge body, so as to reduce chopping action of said at least one blade against the hairs of the beard to be shaved; said vibration capable of imparting a motion to said cartridge body so as to reduce the coefficient of friction between said cartridge body and the face of the user to facilitate shaving comfort.

8. The apparatus of claim 7 generally including an annular housing for said biasing means fixable in the distal end of said annular member and having a flange extending radially inwardly, said biasing means further including;

a coil spring;

a post axially projectable from said switch cam to fit within one end of said coil spring; and a flanged spring retainer capable of receiving the other end of said coil spring, said retainer disposable within said annular housing and said retainer flange engagable with said biasing means housing flange to hold said flanged retainer in place.

9. The apparatus of claim 7 wherein said switch contacts include an annular disk mountable on said switch cam post and having at least one arm extendable therefrom.

* * * * *